US005388416A

United States Patent [19]

Manz et al.

[11] Patent Number: 5,388,416

[45] Date of Patent: Feb. 14, 1995

[54] REFRIGERANT HANDLING METHOD WITH AIR PURGE AND SYSTEM CLEARING CAPABILITIES

[75] Inventors: Kenneth W. Manz, Paulding; Christopher M. Powers, Bryan, both of Ohio

[73] Assignee: SPX Corporation, Muskegon, Mich.

[21] Appl. No.: 279,347

[22] Filed: Jul. 25, 1994

Related U.S. Application Data

[62] Division of Ser. No. 100,424, Aug. 2, 1993.

[51] Int. Cl.[6] ..... F25B 47/00

[52] U.S. Cl. ..... 62/85; 62/195

[58] Field of Search ..... 62/85, 77, 149, 195, 62/292, 475

[56] References Cited

U.S. PATENT DOCUMENTS

| | | | |
|---|---|---|---|
| 1,024,433 | 4/1912 | Bell | 62/475 |
| 4,169,356 | 10/1979 | Kingham | 62/85 |
| 4,441,330 | 4/1984 | Lower et al. . | |
| 4,856,289 | 8/1989 | Lofland . | |
| 5,005,369 | 4/1991 | Manz . | |
| 5,022,230 | 6/1991 | Todack . | |
| 5,063,749 | 11/1991 | Manz . | |
| 5,086,630 | 2/1992 | Van Steenburgh, Jr. . | |
| 5,095,713 | 3/1992 | Laukhuf et al. . | |
| 5,099,653 | 3/1992 | Major et al. . | |
| 5,127,239 | 7/1992 | Manz et al. . | |
| 5,170,632 | 12/1992 | Reilly, Jr. et al. . | |
| 5,181,391 | 1/1993 | Manz . | |
| 5,187,940 | 2/1993 | Paxton . | |

OTHER PUBLICATIONS

"How to Handle Multiple Refrigerants in Recovery and Recycling Equipment", ASHRAE Journal, Apr. 1991, pp. 22–30.

*Primary Examiner*—John M. Sollecito

*Attorney, Agent, or Firm*—Barnes, Kisselle, Raisch, Choate, Whittemore & Hulbert

[57] ABSTRACT

A refrigerant handling system that includes an air purge chamber and a refrigerant pump for directing refrigerant into the air purge chamber so that the refrigerant collects in liquid phase at a lower portion of the chamber while air and other non-condensibles collect in a vapor space at the upper portion of the chamber over the refrigerant. A purge valve is connected to the upper portion of the chamber for automatically or manually purging air and other non-condensibles from the chamber. A refrigerant outlet is positioned at the lower portion of the chamber for drawing liquid phase refrigerant from the chamber. A minimum level of liquid phase refrigerant is maintained in the lower portion of the chamber at the outlet isolating the outlet from the vapor space, and preventing removal of air and other non-condensibles from the chamber through the outlet.

7 Claims, 2 Drawing Sheets

REFRIGERANT HANDLING METHOD WITH AIR PURGE AND SYSTEM CLEARING CAPABILITIES

This application is a division of Ser. No. 08/100,424, filed Aug. 2, 1993.

The present invention is directed to refrigerant handling systems and methods with facility for purging air and other non-condensibles from the refrigerant, and more particularly to an improvement in such systems and methods for selectively clearing the system components, including the air purge mechanism, preparatory to use of the system with a different type of refrigerant.

BACKGROUND AND SUMMARY OF THE INVENTION

In systems for recovering refrigerant from refrigeration equipment under service, there have been a number of techniques proposed for removing or purging air from the recovered refrigerant. For example, in a system in which the refrigerant is pumped to a storage container by a compressor or liquid refrigerant pump, an air purge chamber may be connected between the refrigerant compressor or pump and the storage container for accumulating refrigerant in liquid phase at a lower portion of the chamber, and trapping air and other non-condensibles over the liquid refrigerant at the upper portion of the chamber. The trapped air and non-condensibles may be automatically or manually purged through a suitable valve when pressure becomes excessive.

It is a general object of the present invention to provide a refrigerant handling system and method, particularly a refrigerant recovery system and method, of the described character in which the air purge chamber outlet includes facility for isolating the outlet from the vapor space over the refrigerant, and thereby preventing inadvertent removal of non-condensibles with the liquid refrigerant. Another object of the present invention is to provide a refrigerant handling system of the described character that includes facility for clearing refrigerant from the handling system components, including the air purge chamber, preparatory to service on the system or employing the system in conjunction with a different refrigerant, and thereby preventing venting of the refrigerant to the atmosphere and inadvertent mixing and contamination of different types of refrigerant.

A refrigerant handling system in accordance with a presently preferred embodiments of the invention includes an air purge chamber and a refrigerant pump for directing refrigerant into the air purge chamber so that the refrigerant collects in liquid phase at a lower portion of the chamber while air and other non-condensibles collect in a vapor space at the upper portion of the chamber over the refrigerant. A purge valve is connected to the upper portion of the chamber for automatically or manually purging air and other non-condensibles from the chamber. A refrigerant outlet is positioned at the lower portion of the chamber for drawing liquid phase refrigerant from the chamber while maintaining a seal of liquid phase refrigerant at the outlet within the chamber isolating the outlet from the vapor space, and preventing removal of air and other non-condensibles from the chamber through the outlet. Preferably, this liquid seal is maintained by maintaining a minimum level of liquid phase refrigerant in the lower portion of the chamber at the outlet.

In the preferred embodiments of the invention, the refrigerant pump mechanism comprises a compressor connected through a condenser to the air purge chamber, so that the condenser at least partially condenses refrigerant prior to entry into the air purge chamber. The air purge chamber inlet from the compressor is positioned at a level above the minimum refrigerant level with the chamber that maintains the liquid seal at the chamber outlet. A check valve is connected at one end either to the liquid refrigerant outlet from the air purge chamber or to a separate outlet, and at a second end between the condenser and the chamber inlet. Both the air purge chamber and the condenser may be cleared of refrigerant by connection to the condenser between the compressor and the condenser, and drawing refrigerant from the condenser and from the air purge chamber through the check valve and the condenser. In various embodiments of the invention, minimum liquid refrigerant level is maintained in the air purge chamber by a liquid refrigerant level sensor and a solenoid valve, and by a standpipe at the refrigerant outlet with an open end covered by a baffle.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
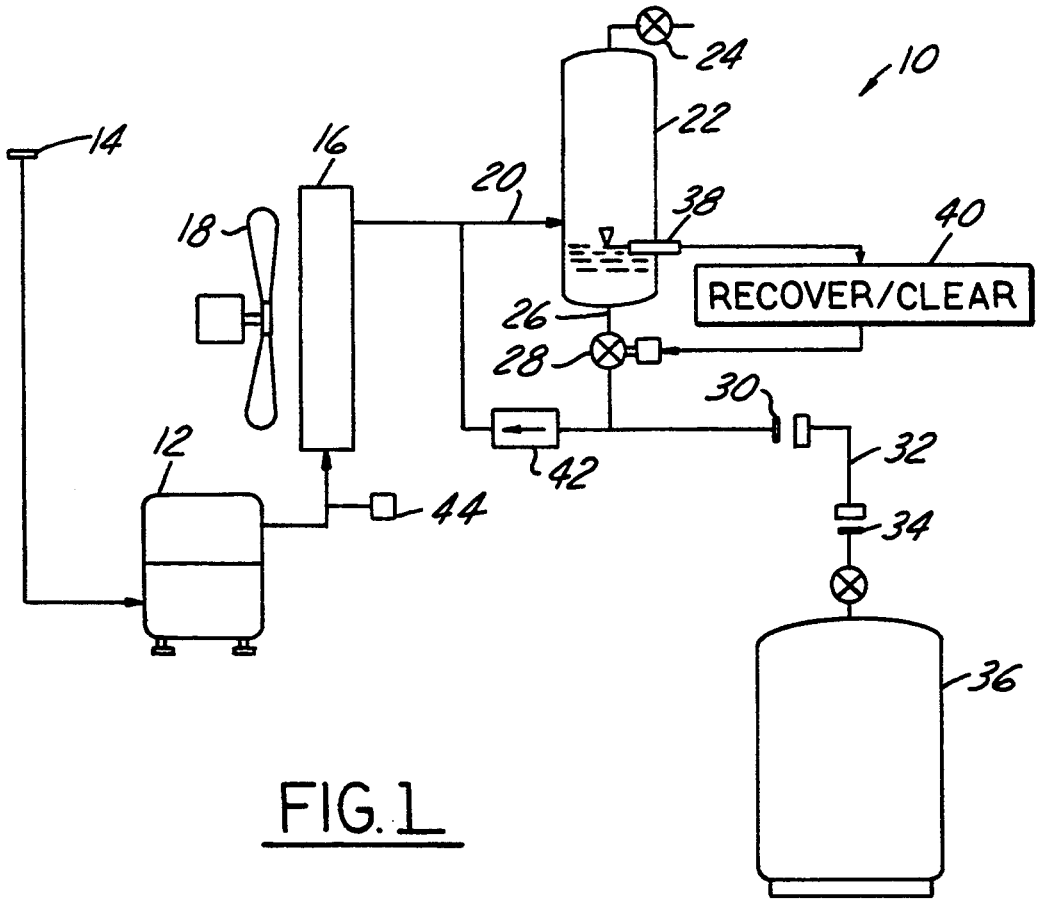
FIG. 1 is a schematic diagram of a refrigerant recovery system in accordance with one presently preferred embodiment of the invention.

FIG. 1 illustrates a refrigerant recovery system 10 in accordance with one presently preferred embodiment of the invention as comprising a refrigerant compressor 12 having an inlet connected to a coupling 14 for connection to a source of refrigerant, such as refrigeration equipment from which refrigerant is to be recovered or a refrigerant storage container from which refrigerant is to be transferred. The outlet of compressor 12 is connected to a condenser 16 cooled by a fan 18 for at least partially, and preferably substantially entirely, condensing refrigerant passing therethrough. The outlet of condenser 16 is connected to the inlet 20 of an air purge chamber 22. A manual valve 24 is connected to the upper portion of air purge chamber 22 for venting air and other non-condensibles from the upper portion of the chamber. An outlet port 26 at the bottom of chamber 22 is connected through a solenoid valve 28 to a fitting 30, which is connected by a hose 32 to a fitting 34 on a refrigerant storage container 36.

With the exception of solenoid valve 28, refrigerant recovery system 10 to the extent thus far described is of generally conventional construction. Inlet coupling 14 is connected to a source of refrigerant, such as a service fitting of refrigeration equipment from which refrigerant is to be recovered or a fitting of a refrigerant storage container from which refrigerant is to be transferred.

When compressor 12 is energized, refrigerant is drawn from the source and pumped through condenser 16 to air purge chamber 22, in which liquid refrigerant collects at the lower portion of the chamber adjacent to outlet 26, and air and other non-condensibles are trapped in the vapor space at the upper portion of chamber 22 over the liquid refrigerant. The trapped air and non-condensibles are vented at valve 24 when pressure thereof exceeds the desired level, while the liquid refrigerant with non-condensibles so removed is fed to storage container 36.

In accordance with the present invention, solenoid valve 28 is connected at outlet 26 of air purge chamber 22 as described above. A liquid level sensor 38 is operatively coupled to chamber 22 to provide an electrical signal when the level of refrigerant is below the sensor. Sensor 38, which may be of any suitable type, is connected through a control module 40 for operating solenoid valve 28 in separate modes for recovering and clearing refrigerant, as will be described. A check valve 42 has an inlet end connected between solenoid valve 28 and fitting 30, and an outlet end connected between condenser 16 and inlet 20 of chamber 22. A service fitting 44 is connected between the outlet of compressor 12 and the inlet 20 of air purge chamber 22.

In a recovery mode of operation, level sensor 38 functions through control 40 to open solenoid valve 28 and transfer refrigerant from chamber 22 to storage container 36 only when the liquid refrigerant level is at or above sensor 38, and closes valve 28 when the liquid refrigerant falls below the level of sensor 38. In this way, a minimum level of liquid refrigerant is maintained within chamber 22 covering chamber outlet 26, thereby isolating the chamber outlet from the vapor space at the upper portion of the vessel, and preventing transfer of air and other non-condensibles from such vapor space through valve 28 to storage container 36. As long as the level of liquid refrigerant within chamber 22 is at or above the level of sensor 38, solenoid valve 28 is held open by control 40 for refrigerant transfer to storage container 36 as described above. When it is desired to clear refrigerant from condenser 16 and chamber 22, such as in preparation of system 10 for use in conjunction with a different type of refrigerant, solenoid valve 28 is opened by control 40 in a clearing mode of operation. A separate pump is connected to service port 44 as described in Manz, "How to Handle Multiple Refrigerants in Recovery and Recycling Equipment," ASHRAE Journal, April 1991, pages 22–30. This pump is then operated to draw liquid refrigerant from condenser 16, and from chamber 22 through outlet 26, valve 28, check valve 42 and condenser 16. Chamber inlet 20 is disposed above the minimum refrigerant level established by sensor 38, so that the liquid refrigerant in chamber 22 cannot be drawn directly from inlet 20.

Figure 2:
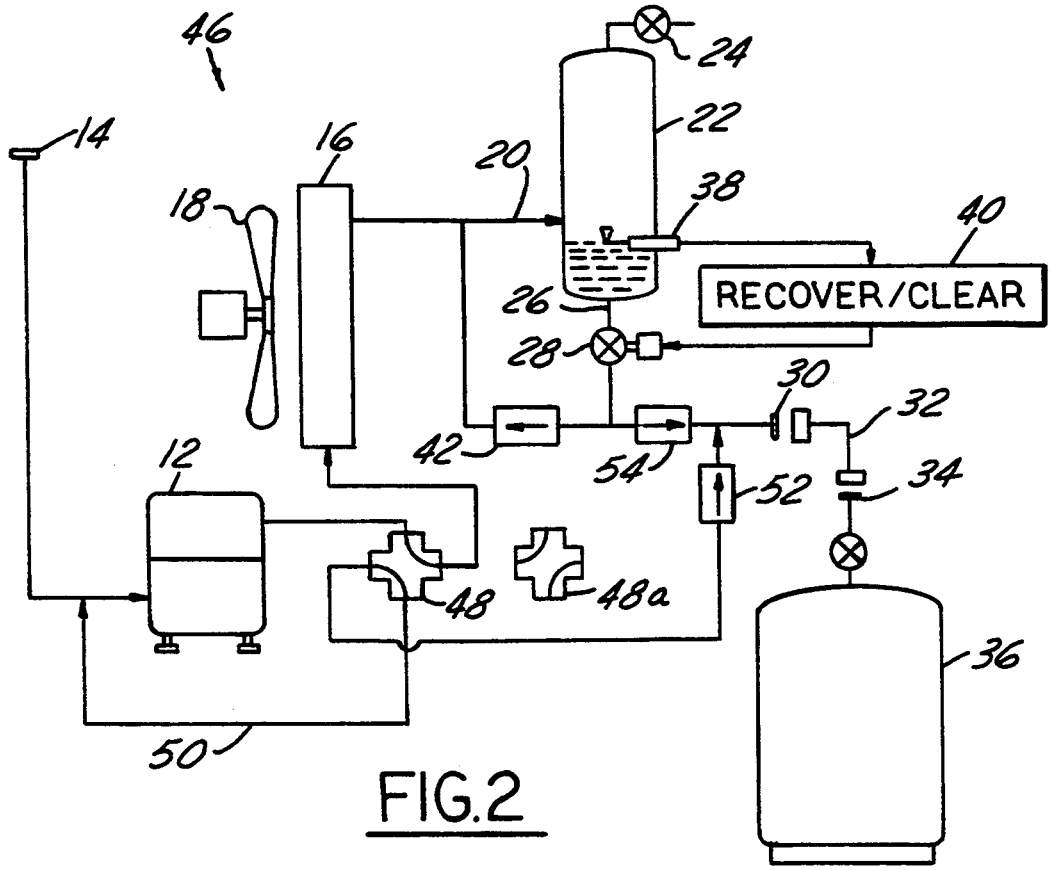
FIG. 2 is a schematic diagram of a refrigerant recovery system with modified system clearing capability as compared with the embodiment of FIG. 1.

FIG. 2 illustrates a modified embodiment 46 of the present invention, in which the service port 44 in FIG. 1 is replaced by a four-way valve 48 that is employed in conjunction with compressor 12 for clearing condenser 16 and air purge chamber 22 as taught in U.S. Pat. No. 5,127,239 assigned to the assignee hereof. That is, in the recovery position of valve 48, the outlet of compressor 12 is connected to condenser 16, and system 46 operates in the same manner as system 10 (FIG. 1) described above. However, in the clearing position 48*a*, condenser 16 is connected through a conduit 50 to the inlet of compressor 12, and the outlet of compressor 12 is connected through a check valve 52 to fitting 30 and storage container 36. A second check valve 54 is positioned between valve 28 and fitting 30 to prevent flow of refrigerant from compressor 12 to check valve 42 in the clearing mode of operation. Thus, with the clearing valve in position 48*a*, compressor 12 is operated to draw refrigerant from condenser 16, and from vessel 22 through outlet 26, valve 28, check valve 42 and condenser 16, and to feed such refrigerant through check valve 52 to storage container 36.

Figure 3:
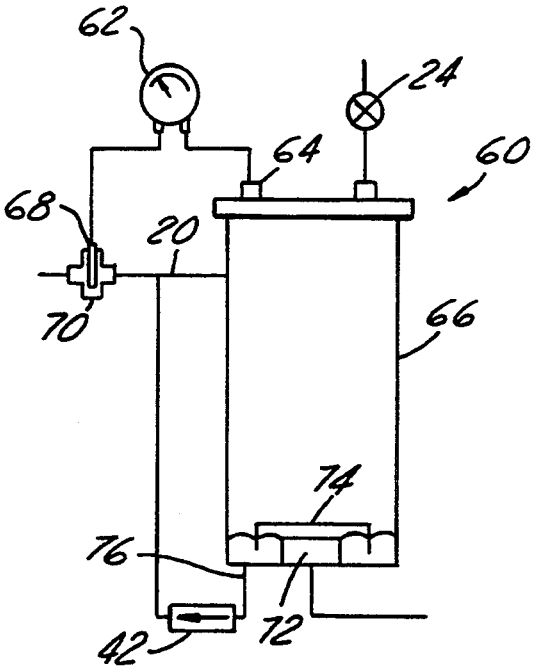
FIGS. 3 and 4 are fragmentary schematic diagrams of respective modified air purge chamber arrangements.

FIG. 3 illustrates a modified air purge chamber arrangement 60 in which a differential pressure gauge 62 is connected to a vapor port 64 of air purge chamber 66, and to a refrigerant bulb 68 in a fitting 70 for heat transfer contact with liquid refrigerant entering inlet 20 of air purge chamber 66. Gauge 62 indicates a need for purging air or other non-condensibles as disclosed in U.S. Pat. Nos. 5,005,369, 5,063,749 and 5,181,391 assigned to the assignee hereof. Air purge valve 24 may be either manually or automatically operated. The liquid refrigerant outlet of air purge chamber 66 comprises a standpipe 72 that extends upwardly into the interior of chamber 66, with an open end covered by an inverted cup-shaped baffle 74. Thus, standpipe 72 establishes a minimum level of liquid phase refrigerant within chamber 66 at the level of the open standpipe end, while baffle 74 cooperates with such minimum liquid refrigerant level to provide a liquid refrigerant seal between the outlet standpipe and the vapor space at the upper portion of the air purge chamber. The inlet end of check valve 42 is connected to a second outlet port 76 at the bottom of chamber 66 for drawing liquid refrigerant directly from within chamber 66 independently of standpipe 72 and baffle 74.

Figure 4:
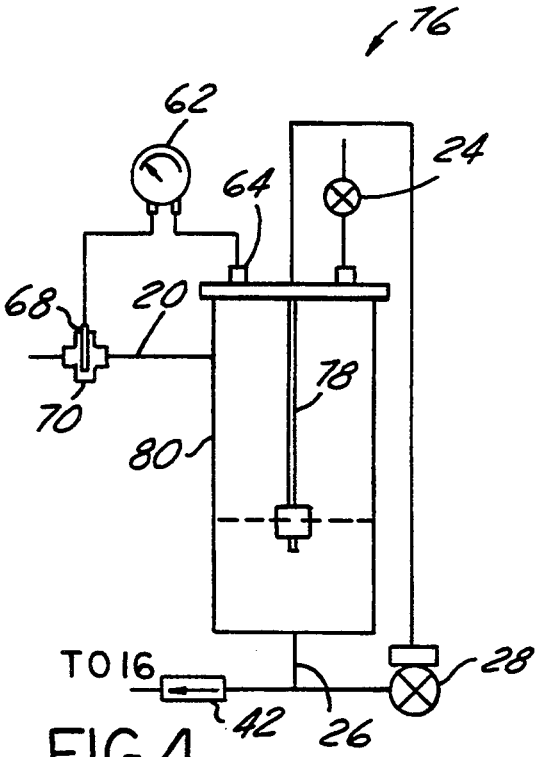

FIG. 4 illustrates a modified air purge chamber arrangement 76 in which a float-type refrigerant level sensor 78 provides an electrical signal to solenoid valve 28 to close the solenoid valve when liquid refrigerant within air purge chamber 80 is at the minimum level, and to open valve 28 when liquid refrigerant is above this level. Check valve 42 is connected to chamber outlet 26 upstream of valve 28, rather than downstream of valve 28 as in FIGS. 1 and 2, so that valve 28 may remain closed during the clearing mode of operation while liquid refrigerant is cleared from within vessel 80 through outlet 26 and check valve 42.

Figure 5:
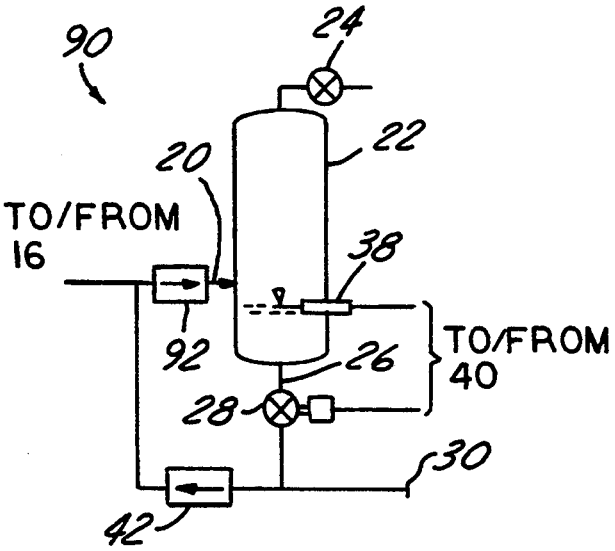
FIGS. 5 and 6 illustrate respective additional modifications to the embodiment of FIG. 1.
Figure 6:
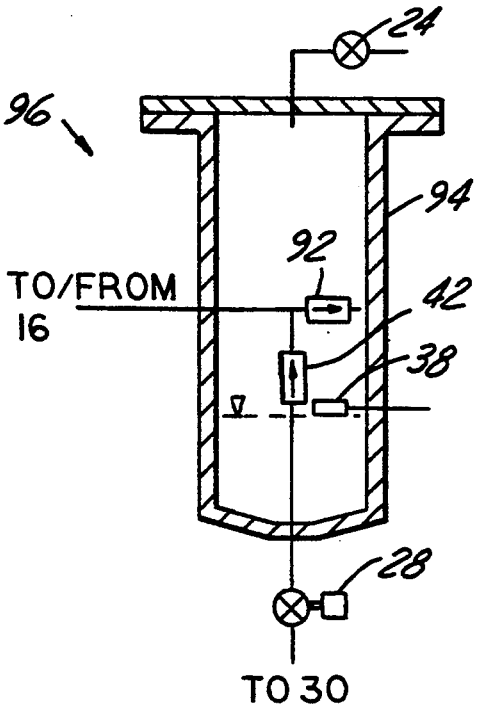

FIG. 5 illustrates a modified air purge arrangement 90 that is identical to FIG. 1, except that a check valve 92 is located between the junction of condenser 16 and check valve 42, and air purge inlet 20. Check valve 92 improves operation in the clearing mode under some operating conditions by preventing reverse flow of refrigerant vapor or non-condensibles from the air purge chamber inlet. FIG. 6 illustrates a modification 96 to FIG. 5 in which check valves 42,92, together with associated plumbing, are mounted within air purge chamber 94. It will be noted that, as in FIG. 4, solenoid valve 28 need not be opened during the clearing operation in the embodiment of FIG. 6.

There have thus been disclosed a number of refrigerant handling systems, particularly refrigerant recovery systems, with air purge capability having a liquid seal to prevent transfer of air and other non-condensibles from the air purge vessel to the storage container or other use device, and with facility for clearing system components including the air purge vessel of liquid refrigerant. The various embodiments offer the additional advantage of obtaining lower levels of non-condensible contaminants than the air purge detection mechanism, such as gauge 62 in FIGS. 3 and 4, can directly measure. In essence, the air purge arrangements of the present invention allow increase in the partial pressure of air or other contaminants over the liquid refrigerant where such partial pressure can be detected, while inhibiting migration through or with the liquid out of the air purge vessel. For example, if a partial pressure of air of 2 psig were allowable for R12 refrigerant at 100° F. to meet a new product specification of equal to or less than 1.5% non-condensibles, the liquid level trap arrangement of the present invention would allow purging to begin at a level of 10 psig, for example, and terminate at a level of 4 psig while maintaining less than 1.5% non-condensibles at the air purge chamber outlet.

We claim:

1. A method of purging non-condensibles from refrigerant comprising the steps of:

(a) directing the refrigerant into a chamber such that the refrigerant collects in liquid phase at a lower portion of the chamber and non-condensibles are trapped in the upper portion of the chamber over the liquid refrigerant, (b) purging the non-condensibles trapped in the upper portion of the chamber, (c) withdrawing refrigerant from an outlet at the lower portion of the chamber in a first mode of operation while maintaining a minimum level of refrigerant within the chamber forming a liquid seal at the outlet to isolate the outlet from the upper portion of the chamber, and (d) withdrawing all refrigerant from the chamber in a second mode of operation independent of liquid refrigerant level.

2. A method of purging non-condensibles from refrigerant comprising the steps of:

(a) directing the refrigerant into a chamber such that the refrigerant collects in liquid phase at a lower portion of the chamber and non-condensibles are trapped in the upper portion of the chamber over the liquid refrigerant, (b) purging the non-condensibles trapped in the upper portion of the chamber, (c) withdrawing refrigerant in liquid phase from an outlet at the lower portion of the chamber in a first mode of operation while maintaining a minimum level of liquid phase refrigerant within the chamber forming a liquid seal at the outlet to isolate the outlet from the upper portion of the chamber and prevent removal of non-condensibles from said chamber through said outlet, and (d) withdrawing all refrigerant from the chamber in a second mode of operation independent of liquid refrigerant level.

3. A method of purging non-condensibles from refrigerant comprising the steps of:

(a) directing the refrigerant into a chamber such that the refrigerant collects in liquid phase at a lower portion of the chamber and non-condensibles are trapped in the upper portion of the chamber over the liquid refrigerant, (b) purging the non-condensibles trapped in the upper portion of the chamber, (c) withdrawing refrigerant in liquid phase from an outlet at the lower portion of the chamber in a first mode of operation while maintaining a minimum level of liquid phase refrigerant within the chamber forming a liquid seal at the outlet to isolate the outlet from the upper portion of the chamber, and (d) withdrawing all refrigerant from the chamber in a second mode of operation independent of liquid refrigerant level, while maintaining integrity of said chamber against ingress of air during said second mode of operation and release of refrigerant into the surrounding atmosphere during said second mode of operation.

4. The method set forth in claim 3 wherein said minimum level of refrigerant is maintained in said step (c) by sensing level of liquid refrigerant in said chamber, and preventing removal of liquid refrigerant from said chamber in said first mode of operation when liquid refrigerant level reaches a preselected minimum level covering said outlet.

5. The method set forth in claim 3 wherein said minimum level of refrigerant is maintained in said step (c) by providing a standpipe in said chamber coupled to said outlet, and positioning a baffle over an upper end of said standpipe so as to block egress of liquid refrigerant through said standpipe when level thereof reaches said open end of said standpipe.

6. The method set forth in claim 3 wherein said steps (c) and (d) are accomplished by withdrawing refrigerant through the same said outlet in said first and second modes of operation respectively.

7. The method set forth in claim 3 wherein aid step (a) is accomplished by connecting a refrigerant compressor to said chamber through a condenser for at least partially condensing refrigerant directed into said chamber through said condenser, and where said step (d) is accomplished by withdrawing refrigerant from said chamber through a check valve and said condenser so as simultaneously to clear both said chamber and said condenser.

* * * * *